US009666399B1

(12) United States Patent
I

(10) Patent No.: US 9,666,399 B1
(45) Date of Patent: May 30, 2017

(54) METAL AND PLASTIC SAFETY CLIP TO PROTECT AGAINST OVERHEATING IN A PLUG OR SOCKET

(71) Applicant: Green Idea Tech Inc., Mahe (SC)

(72) Inventor: Hsiang-Yun I, Tainan (TW)

(73) Assignee: GREEN IDEA TECH INC., Mahe (SC)

( * ) Notice: Subject to any disclaimer, the term of this patent is extended or adjusted under 35 U.S.C. 154(b) by 0 days.

(21) Appl. No.: 15/164,412

(22) Filed: May 25, 2016

(51) Int. Cl.
*H01R 13/68* (2011.01)
*H01H 85/08* (2006.01)
*H01H 85/06* (2006.01)

(52) U.S. Cl.
CPC ..... *H01H 85/08* (2013.01); *H01H 85/06* (2013.01); *H01R 13/68* (2013.01)

(58) Field of Classification Search
CPC .... H01R 13/68; H01R 13/684; H01R 13/688; H01R 13/696; H01H 85/20; H01H 85/201; H01H 85/203
USPC ..... 439/620.3, 620.26, 620.92, 698; 337/190, 142, 208, 227, 231, 256
See application file for complete search history.

(56) References Cited

U.S. PATENT DOCUMENTS

| | | | | |
|---|---|---|---|---|
| 6,348,851 | B1 * | 2/2002 | Wyser | H01H 37/761 337/31 |
| 6,741,159 | B1 * | 5/2004 | Kuczynski | H01H 37/002 337/142 |
| 7,639,114 | B2 * | 12/2009 | Yu | H01H 37/761 29/623 |
| 9,484,683 | B1 * | 11/2016 | Wang | H01R 13/696 |
| 2005/0195547 | A1 * | 9/2005 | Huang | H01R 13/696 361/103 |

FOREIGN PATENT DOCUMENTS

| | | |
|---|---|---|
| TW | M477079 U | 4/2014 |
| TW | M509999 U | 10/2015 |

* cited by examiner

*Primary Examiner* — Vanessa Girardi
(74) *Attorney, Agent, or Firm* — Muncy, Geissler, Olds & Lowe, P.C.

(57) ABSTRACT

An overheating destructive conductive plate safety clip as well as a plug and a socket using that conductive plate safety clip are disclosed. The overheating destructive conductive plate safety clip limits two conductive plates from contacting with each other to form a closed path, and is destructed when overheating, opening the two conductive plates by an elastic force to form an open circuit. The overheating destructive conductive plate safety clip includes a first limiting element, a second limiting element and a connecting element. At least one of the first limiting element, the second limiting element and the connecting element is made of plastic, at least one of the first limiting element and the second limiting element is made of metal, and a destruction part is formed at a place where the plastic material is connected with the metallic material.

26 Claims, 20 Drawing Sheets

METAL AND PLASTIC SAFETY CLIP TO PROTECT AGAINST OVERHEATING IN A PLUG OR SOCKET

BACKGROUND OF THE INVENTION a) Field of the Invention

The present invention relates to an overheating destructive conductive plate safety clip as well as a plug and a socket using that conductive plate safety clip. The overheating destructive conductive plate safety clip enables two conductive plates to be limited from contacting with each other, forming a closed path. In addition, the overheating destructive conductive plate safety clip is destructed when overheating, which enables the two conductive plates to be opened with respect to each other by an elastic force, forming an open circuit. The overheating destructive conductive plate safety clip is formed by combining metal with plastic, forming a destruction part. The destruction part is assured to be destructe completely using the advantage that metal is provided with a good thermal conductivity.

b) Description of the Prior Art

To prevent a circuit from current overloading, short-circuit or overheating, the circuit will be usually provided with a fuse or a breaker. When the circuit temperature is too high or the current is too large, the fuse will be melted down by high temperature or the metal spring leaves of the breaker will be ejected, which forms an open circuit to power off the circuit, thereby securing the safety in using electricity.

A Taiwanese Utility Model Patent No. M477079, "Overheat Failure Safety Structure and a Plug and a Socket with Overheat Failure Safety Structure," has disclosed an insulative limiting element which connects two conductive elements to form a closed path. When the circuit is overheated, the insulative limiting element will be melted and broken, enabling the two conductive elements to be opened with respect to each other by an elastic force to form an open circuit. The limiting element is provided with a first insulative part and an opposite second insulative part. A connecting part is used to connect the first insulative part with the second insulative part, forming a U-shaped appearance and having an open end. The two conductive elements are clamped tightly at the open end.

Upon practically using that patent, the present inventor has found out that as the U-shaped limiting element may not have sufficient rigidity of combination; even the closed path between the two conductive elements is not overheated, the binding force of the U-shaped limiting element can be still reduced due to heat-up and the limiting element can be ejected off by the elastic force between the two conductive elements, thereby forming an open circuit between the two conductive elements. On the other hand, when the temperature between the two conductive elements is too high, the first insulative part and the second insulative part of the U-shaped limiting element will be ejected off by the elastic force between the two conductive elements. However, as the connecting part is still connected at the first insulative part and the second insulative part, the U-shaped limiting element will maintain a part of the binding force, so that the two conductive elements will keep partly contact, thereby being unable to power off the circuit completely. All the two situations described above are the possible false actions.

Furthermore, another Taiwanese Utility Model Patent No. M509999, "Overheating Destructive Insulative Fixing Plate as well as a Plug and a Socket Using that Insulative Fixing Plate," has disclosed an overheating destructive insulative fixing plate, which includes a connecting element and two limiting elements combined at two ends of the connecting element to form an H-shaped structure. The connecting element is put into the grooves formed on two conductive elements, enabling the two limiting elements to be abutted at an exterior side of the conductive element respectively and limiting the two conductive elements from contacting with each other. The connecting element is destructed when overheating, forming an open circuit between the two conductive elements.

However, upon practically using that patent, the present inventor has found out that as the two limiting elements are all made of plastic, if the plastic material is not chosen properly, the heat conduction effect will be inferior. When the connecting element is softened by heat to reduce the binding force, the two limiting elements will be ejected off by the elastic force between the two conductive elements. At this time, as the heat conduction effect of the two limiting elements is reduced, the connecting element may not be destructed completely that the two limiting elements can contact with each other intermittently, so that the conductive elements may keep partly contact, thereby being unable to power off the circuit completely.

SUMMARY OF THE INVENTION

Accordingly, in order to solve the possible shortcomings in using the overheating destructive insulative fixing plate which is totally made of plastic, the present invention further discloses an overheating destructive conductive plate safety clip which is formed by combining metal with plastic. The overheating destructive conductive plate safety clip is used to limit two conductive plates from contacting with each other, forming a closed path. In addition, the conductive plate safety clip is destructed when overheating, such that the two conductive plates can be opened with respective to each other by an elastic force, forming an open circuit.

The overheating destructive conductive plate safety clip includes a first limiting element, a second limiting element and a connecting element. The connecting element is connected with the first limiting element and the second limiting element. A holding space is defined among the first limiting element, the connecting element and the second limiting element to contain the two conductive plates, enabling the first limiting element and the second limiting element to be abutted at an exterior side of the conductive plate respectively and limiting the two conductive plates from contacting with each other. At least one of the first limiting element, the second limiting element and the connecting element is made of plastic, and at least one of the first limiting element and the second limiting element is made of metal. A destruction part is formed at a place where the plastic material is connected with the metallic material. When the two conductive plates are overheated, the destruction part will be destructed completely as heat is absorbed by the metallic material in the first limiting element or the second limiting element.

Furthermore, the first limiting element and the connecting element are made of metal, the second limiting element is made of plastic, and each of the said conductive plates is provided with a groove respectively. Each groove is concaved in from an edge of the said conductive plate and the grooves on the two conductive plates are opposite to each other. The cross section of the first limiting element, the connecting element and the second limiting element is in an H-shape, enabling the connecting element to be put into the grooves, so that the two conductive plates can be contained in the holding space. The overheating destructive conductive plate safety clip is provided with following structures:

1. A groove is first formed on the second limiting element, and then the connecting element is latched into that groove through secondary processing.
2. The first limiting element is a head part of a bolt, the connecting element is a threaded part of the bolt, and the second limiting element is formed with a threaded hole to be screwed in by the threaded part.
3. The second limiting element is connected with the connecting element through bagging formation.
4. The connecting element is formed by stamping the first limiting element.
5. The first limiting element and the connecting element are formed by bending a wire.

Furthermore, the first limiting element and the connecting element are made of metal, and the second limiting element is made of plastic. The first limiting element, the connecting element and the second limiting element wrap into an annular closed holding space, so that the two conductive plates can be sheathed and contained in the holding space. Two opposite sides of the first limiting element are formed respectively with a fin.

Furthermore, the first limiting element and the connecting element are made of plastic, and the second limiting element is made of metal. Each of the two conductive plates is provided with a groove which is concaved in from the edge of the said conductive plate. The grooves on the two conductive plates are opposite to each other. The cross section of the first limiting element, the connecting element and the second limiting element is in an H-shape, enabling the connecting element to be put into the grooves, so that the two conductive plates can be contained in the holding space. The overheating destructive conductive plate safety clip includes the following structures:

1. A through-hole is first formed on the second limiting element, and then the connecting element is latched into the through-hole through secondary processing.
2. The first limiting element is a head part of a bolt, the connecting element is a threaded part of the bolt, and the second limiting element is formed with a threaded hole to be screwed in by the threaded part.
3. The second limiting element is provided with a through-hole, whereas the first limiting element and the connecting element are connected with the second limiting element and latched into the through-hole through bagging formation.
4. The second limiting element is formed with a bump and the bump is provided with a notch. The connecting element is connected with the second limiting element and then latched into the notch of the bump.
5. The second limiting element is first stamped into a protruded part, and the protruded part is provided with a coupling hole. The connecting element is connected with the protruded part of the second limiting element and then latched into the coupling hole.

Furthermore, the first limiting element and the connecting element are made of plastic, and the second limiting element is made of metal. The first limiting element, the connecting element and the second limiting element wrap into an annular closed holding space, so that the two conductive plates can be sheathed and contained in the holding space. The overheating destructive conductive plate safety clip includes the following structures:

1. A recessed hole is first formed on the second limiting element, and the connecting element is connected with the second limiting element and then latched into the recessed hole.
2. The second limiting element is formed with a projected part, and the projected part is provided with a slot hole. The connecting element is connected with the projected part and then latched into the slot hole.

Furthermore, the connecting element is made of plastic, and the first limiting element and the second limiting element are made of metal. Each of the two conductive plates is provided with a groove which is concaved in from the edge of the said conductive plate. The grooves on the two conductive plates are opposite to each other. The cross section of the first limiting element, the connecting element and the second limiting element is in an H-shape, enabling the connecting element to be put into the grooves, so that the two conductive plates can be contained in the holding space. The overheating destructive conductive plate safety clip includes the following structures:

1. A through-hole is first formed on the first limiting element and the second limiting element, and then the connecting element is latched into the through-hole through secondary processing.
2. The connecting element is connected with the first limiting element and the second limiting element through bagging formation.

The present invention also discloses a plug using the abovementioned overheating destructive conductive plate safety clip. The plug includes an insulative unit, a live wire pin, a neutral line pin, a live wire and a neutral line. The live wire pin and the neutral line pin are all disposed in the insulative unit and extended out of the insulative unit. Besides that, the live wire pin and the neutral wire pin are provided respectively with a first groove which is concaved in from an edge of the live wire pin and from an edge of the neutral line pin. The live wire and the neutral line are provided respectively with a second groove which is concaved in from an edge of the live wire and from an edge of the neutral line.

By putting the connecting element of the overheating destructive conductive plate safety clip into the first groove of the live wire pin and the second groove of the live wire, and using the first limiting element and the second limiting element of the overheating destructive conductive plate safety clip to restrain the live wire pin and the live wire, the live wire pin and the live wire can contact with each other to form a closed path; and by putting the connecting element of the overheating destructive conductive plate safety clip into the first groove of the neutral line pin and the second groove of the neutral line, and using the first limiting element and the second limiting element of the overheating destructive conductive plate safety clip to restrain the neutral line pin and the neutral line, the neutral line pin and the neutral line can contact with each other to form a closed path. When the live wire pin and the live wire are overheated or when the neutral line pin and the neutral line are overheated, as heat is absorbed by the metallic material in the first limiting element or the second limiting element, the destruction part will be destructed completely, so that by an elastic force, the live wire pin is opened with respect to the live wire and the neutral line pin is opened with respect to the neutral line, thereby forming an open circuit.

The present invention also discloses a socket using the abovementioned overheating destructive conductive plate safety clip. The socket includes an insulative unit, a live wire terminal, a neutral line terminal, a live wire and a neutral line. The insulative unit is provided at least with a live wire receptacle and a corresponding neutral line receptacle. The live wire terminal is installed in the insulative unit, opposite to the live wire receptacle. The neutral line terminal is installed in the insulative unit, opposite to the neutral line receptacle. The live wire terminal and the neutral line terminal are provided respectively with a first groove which is concaved in from an edge of the live wire terminal and from an edge of the neutral line terminal. The live wire corresponds to the live wire terminal, and the neutral line corresponds to the neutral line terminal. In addition, the live wire and the neutral line are provided respectively with a second groove which is concaved in from an edge of the live wire and from an edge of the neutral line.

By putting the connecting element of the overheating destructive conductive plate safety clip into the first groove of the live wire terminal and the second groove of the live wire, and using the first limiting element and the second limiting element of the overheating destructive conductive plate safety clip to restrain the live wire terminal and the live wire, the live wire terminal and the live wire can contact with each other to form a closed path; and by putting the connecting element of the overheating destructive conductive plate safety clip into the first groove of the neutral line terminal and the second groove of the neutral line, and using the first limiting element and the second limiting element of the overheating destructive conductive plate safety clip to restrain the neutral line terminal and the neutral line, the neutral line terminal and the neutral line can contact with each other to form a closed path. Furthermore, when the live wire terminal and the live wire are overheated or when the neutral line terminal and the neutral line are overheated, as heat is absorbed by the metallic material in the first limiting element or the second limiting element, the destruction part will be destructed completely, so that by an elastic force, the live wire terminal is opened with respect to the live wire and the neutral line terminal is opened with respect to the neutral line, thereby forming an open circuit.

The benefits of the present invention lie in that:

1. The overheating destructive conductive plate safety clip is made of metal associated with plastic. Therefore, by the property that the metallic material is provided with a good thermal conductivity, the destruction part can be assured to be destructed completely when the conductive plates are overheated, thereby securing the conductive plates to be powered off.
2. In the overheating destructive conductive plate safety clip, several structure configurations, including that the first limiting element and the connecting element are made of metal and the second limiting element is made of plastic, or the first limiting element and the connecting element are made of plastic and the second limiting element is made of metal, or the connecting element is made of metal and the first limiting element and the second limiting element are made of metal, are disclosed. However, the abovementioned structure configurations will not limit the range of the present invention, and as long as that the overheating destructive conductive plate safety clip is made of metal along with plastic, it will be included in the claims of the present invention.
3. The plug of the present invention is provided with the abovementioned overheating destructive conductive plate safety clip. Therefore, when the working temperature increases abnormally, the plug can be powered off automatically due to the destruction to the overheating destructive conductive plate safety clip, thereby securing the safety in using electricity.
4. The socket of the present invention is provided with the abovementioned overheating destructive conductive plate safety clip. Therefore, when the working temperature increases abnormally, the socket can be powered off automatically due to the destruction to the overheating destructive conductive plate safety clip, thereby securing the safety in using electricity.

To enable a further understanding of the said objectives and the technological methods of the invention herein, the brief description of the drawings below is followed by the detailed description of the preferred embodiments.

DETAILED DESCRIPTION OF THE PREFERRED EMBODIMENTS

According to the abovementioned technical features, the primary benefits of the overheating destructive conductive plate safety clip can be clearly disclosed in the following embodiments.

Figure 1:
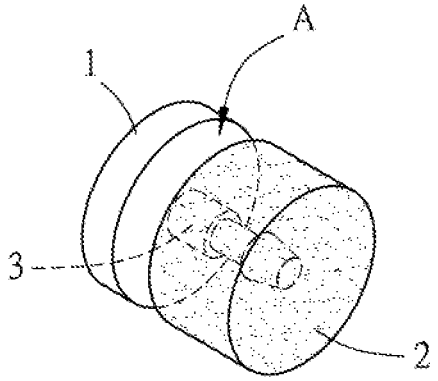
FIG. 1 shows a three-dimensional view of appearance of an overheating destructive conductive plate safety clip, according to a first embodiment of the present invention.
Figure 2:
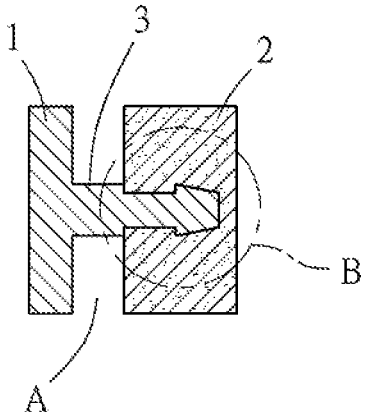
FIG. 2 shows a cutaway view of the overheating destructive conductive plate safety clip, according to the first embodiment of the present invention.

Referring to FIG. 1 and FIG. 2 for the first embodiment of the present invention, the overheating destructive conductive plate safety clip, according to the present embodiment, comprises a first limiting element 1, a second limiting element 2 and a connecting element 3. The connecting element 3 is connected with the first limiting element 1 and the second limiting element 2, forming an H-shaped structure to the overheating destructive conductive plate safety clip. A holding space A is defined among the first limiting element 1, the connecting element 3 and the second limiting element 2. The first limiting element 1 and the connecting element 3 are made of metal, the second limiting element 2 is made of plastic, and a destruction part B is formed at a place where the plastic material is connected with the metallic material.

Figure 3:
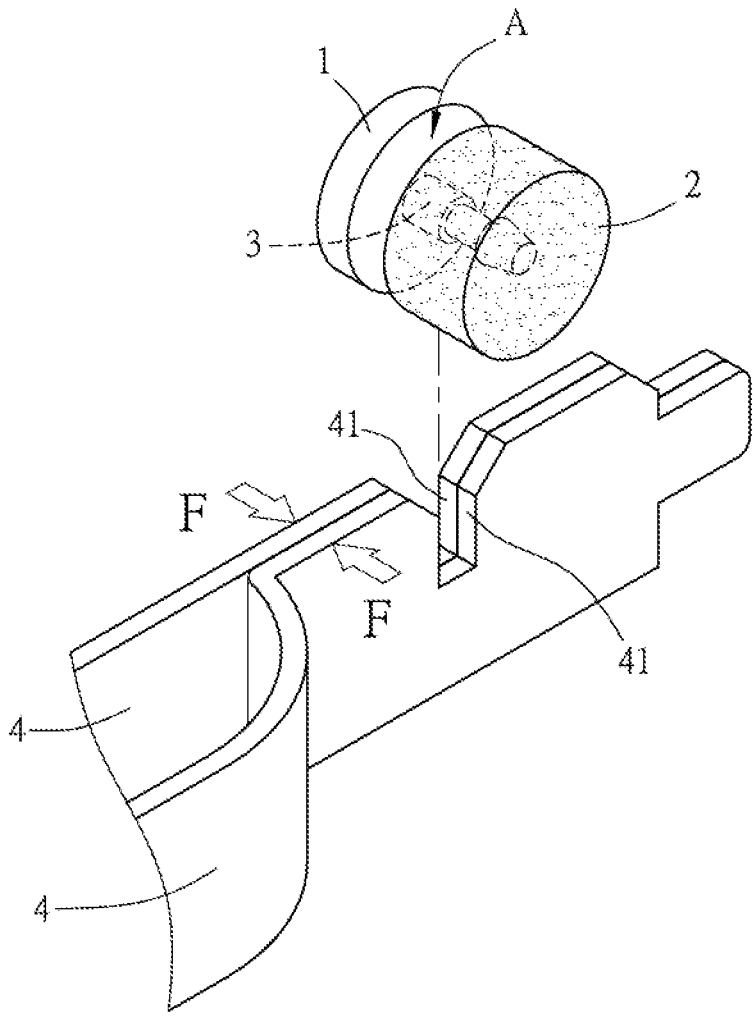
FIG. 3 shows an exploded view of combining the overheating destructive conductive plate safety clip with the conductive plates, according to the first embodiment of the present invention.
Figure 4:
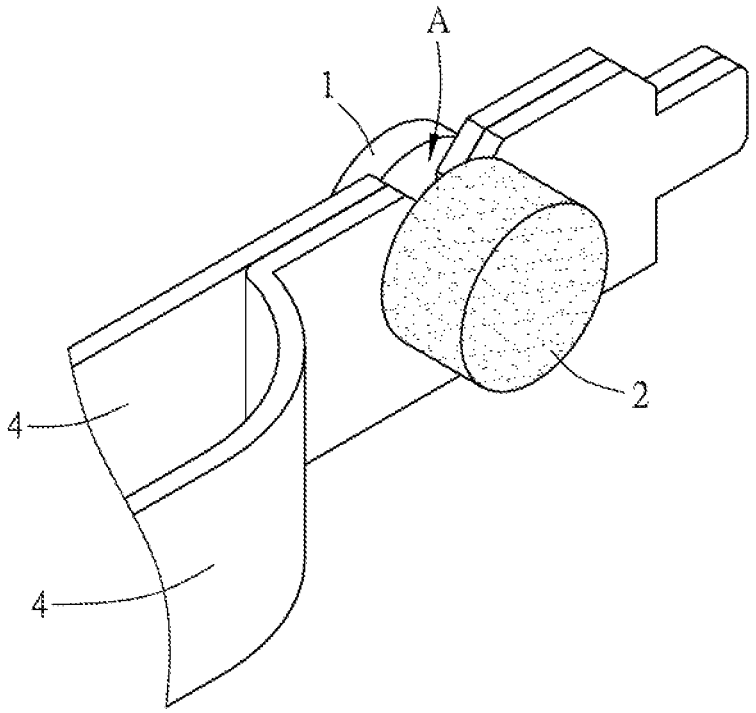
FIG. 4 shows a schematic view of combining the overheating destructive conductive plate safety clip with the conductive plates, according to the first embodiment of the present invention.

Referring to FIG. 3 and FIG. 4, there are two conductive plates 4 and each conductive plate 4 is provided with a groove 41 which is concaved in from an edge of the abovementioned conductive plate 4. The grooves 41 on the two conductive plates 4 are opposite to each other. An external force F is applied first to enable the two conductive plates 4 to close to each other. Next, the connecting element 3 is put into the grooves 41, enabling the two conductive plates 4 to be contained in the holding space A, such that the first limiting element 1 and the second limiting element 2 can be abutted at an external sides of the conductive plate 4 respectively and the two conductive plates 4 can be limited from contacting with each other to form a closed path.

Figure 5:
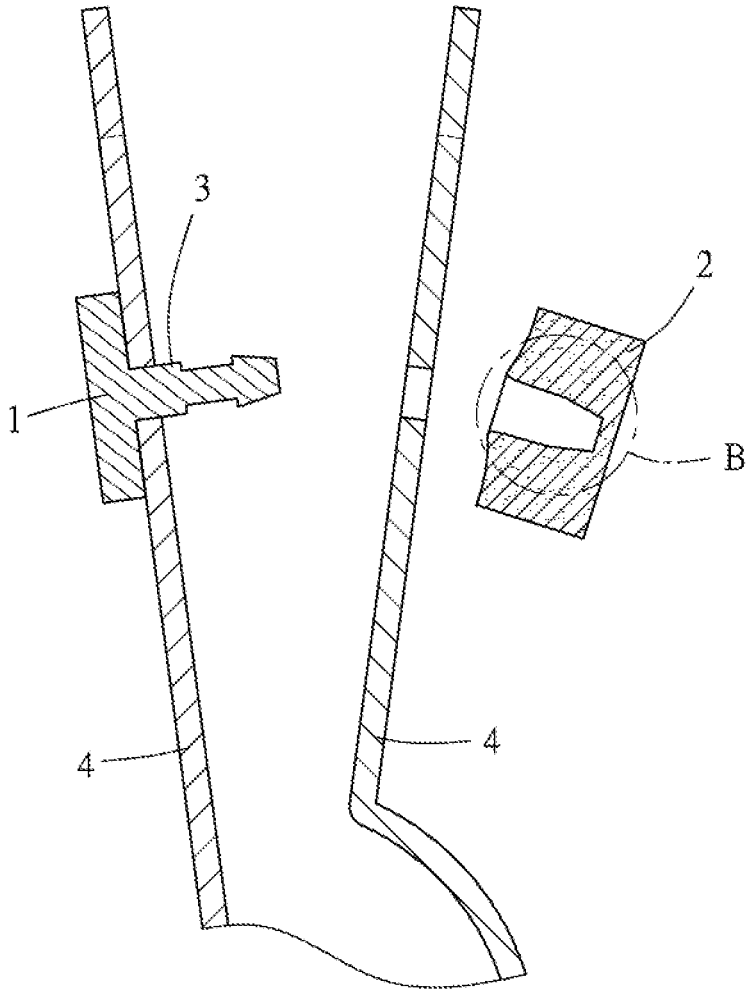
FIG. 5 shows a schematic view illustrating that the overheating destructive conductive plate safety clip is destructed due to the overheating of the conductive plates, according to the first embodiment of the present invention.

Referring to FIG. 5, as metal is provided with a good thermal conductivity, when the two conductive plates 4 are overheated to melt and extend the plastic second limiting element 2, the metallic first limiting element 1 can absorb a large amount of heat from the said conductive plates 4 continuously and transfer the heat to the second limiting element 2 through the metallic connecting element 3 continuously, such that the destruction part B can be heated up and destructed surely, enabling the two conductive plates 4 to form an open circuit actually.

Figure 6:
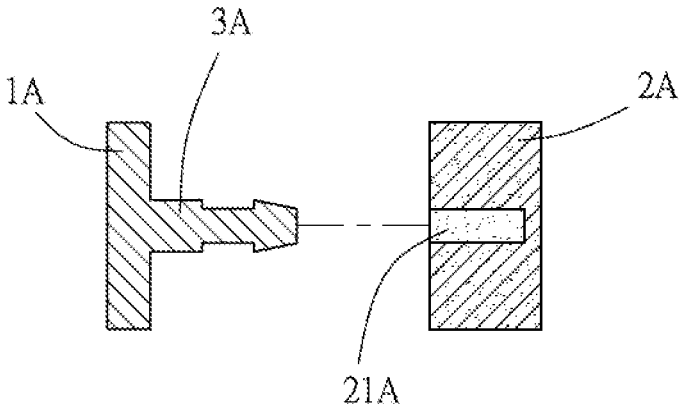
FIG. 6 shows a schematic view of a first kind of structure configuration of the overheating destructive conductive plate safety clip, according to the first embodiment of the present invention.
Figure 7:
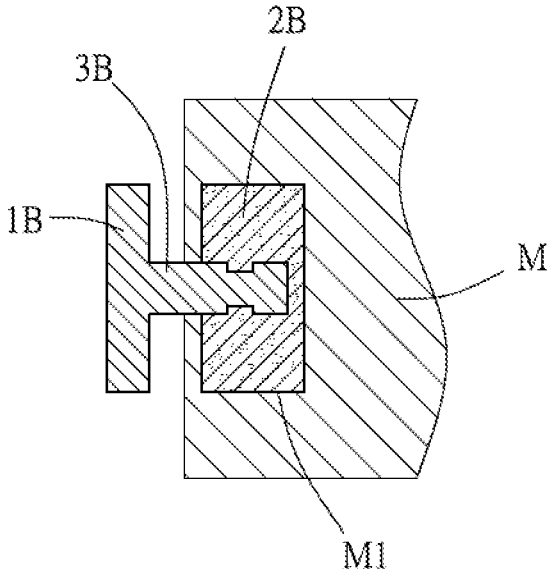
FIG. 7 shows a schematic view of a second kind of structure configuration of the overheating destructive conductive plate safety clip, according to the first embodiment of the present invention.
Figure 8:
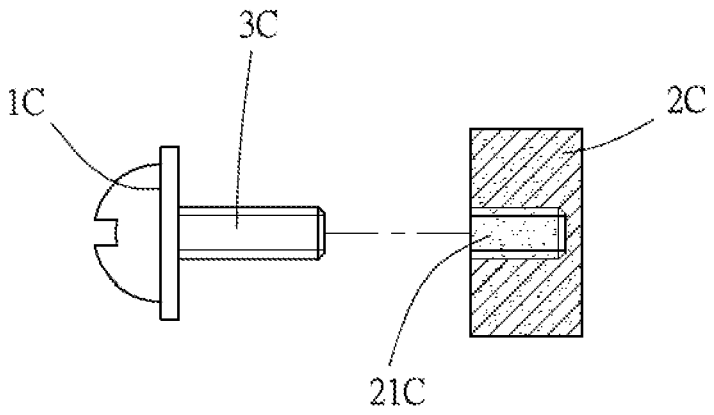
FIG. 8 shows a schematic view of a third kind of structure configuration of the overheating destructive conductive plate safety clip, according to the first embodiment of the present invention.

The overheating destructive conductive plate safety clip is provided with following structures:

1. As shown in FIG. 6, the overheating destructive conductive plate safety clip includes a first limiting element 1A, a second limiting element 2A and a connecting element 3A. The first limiting element 1A is integrally formed with the connecting element 3A, a groove 21A is first formed on the second limiting element 2A, and then the connecting element 3A is latched into the groove 21A through secondary processing.
2. As shown in FIG. 7, the overheating destructive conductive plate safety clip includes a first limiting element 1B, a second limiting element 2B and a connecting element 3B. The first limiting element 1B is integrally formed with the connecting element 3B, the connecting element 3B is extended into a mold cavity M1 of a mold M and is then formed with the second limiting element 2B through bagging formation.
3. As shown in FIG. 8, the overheating destructive conductive plate safety clip includes a first limiting element 1C, a second limiting element 2C and a connecting element 3C. The first limiting element 1C is a head part of a bolt, the connecting element 3C is a threaded part of the bolt, and the second limiting element 2C is formed with a threaded hole 21C to be screwed in by the threaded part.

Figure 9:
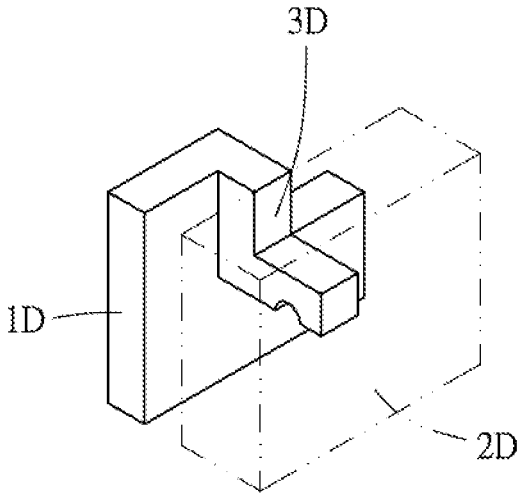
FIG. 9 shows a schematic view of a fourth kind of structure configuration of the overheating destructive conductive plate safety clip, according to the first embodiment of the present invention.
Figure 10:
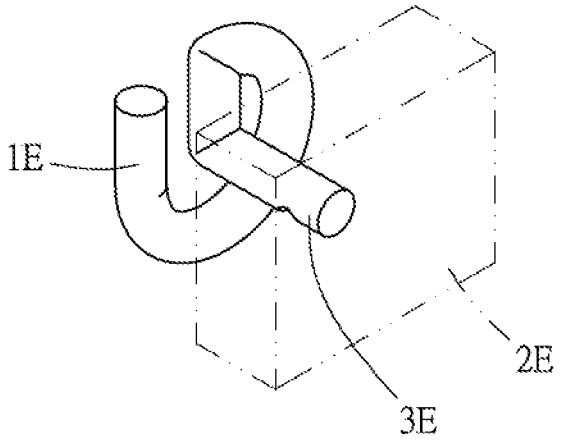
FIG. 10 shows a schematic view of a fifth kind of structure configuration of the overheating destructive conductive plate safety clip, according to the first embodiment of the present invention.

4. As shown in FIG. 9, the overheating destructive conductive plate safety clip includes a first limiting element 1D, a second limiting element 2D and a connecting element 3D. The connecting element 3D is formed by stamping the first limiting element 1D and is then connected with the second limiting element 2D.
5. As shown in FIG. 10, the overheating destructive conductive plate safety clip includes a first limiting element 1E, a second limiting element 2E and a connecting element 3E. The first limiting element 1E and the connecting element 3E are formed by bending a wire and are then connected with the second limiting element 2E.

Figure 11:
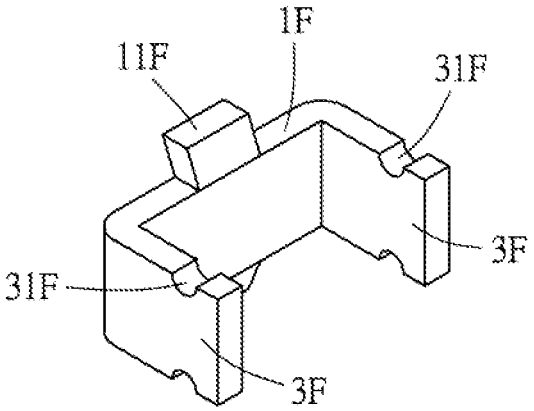
FIG. 11 shows a schematic view illustrating that a first limiting element is integrally formed with a connecting element of an overheating destructive conductive plate safety clip, according to a second embodiment of the present invention.
Figure 12:
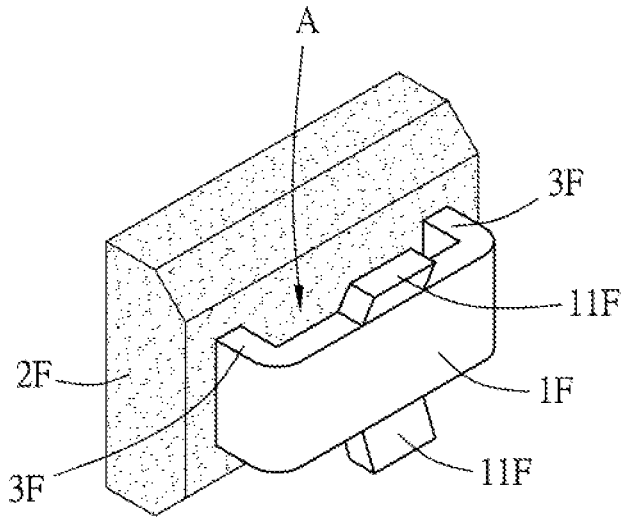
FIG. 12 shows a three-dimensional view of appearance of the overheating destructive conductive plate safety clip, according to the second embodiment of the present invention.
Figure 13:
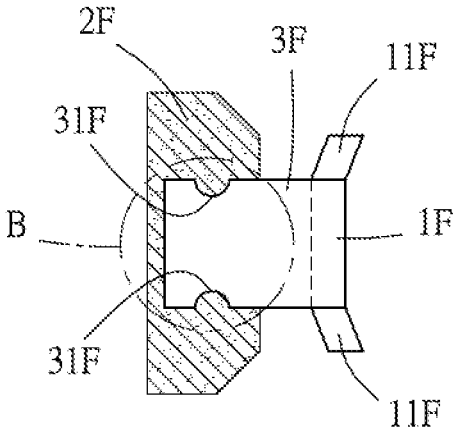
FIG. 13 shows a cutaway view of the overheating destructive conductive plate safety clip, according to the second embodiment of the present invention.

Referring to FIGS. 11 to 13 for the second embodiment of the present invention, the overheating destructive conductive plate safety clip, according to the present embodiment, comprises a first limiting element 1F, a second limiting element 2F and a connecting element 3F. The first limiting element 1F and the connecting element 3F are formed integrally by bending a board into an inverted-U-shaped structure. A notch 31F is formed on the connecting element 3F and then the connecting element 3F is connected with the second limiting element 2F which is latched into the notch 31F. The first limiting element 1F, the connecting element 3F and the second limiting element 2F wrap into an annular closed holding space A. In the present embodiment, two opposite sides of the first limiting element 1F are further formed respectively with a fin 11F. The first limiting element 1F and the connecting element 3F are made of metal, the second limiting element 2F is made of plastic, and a destruction part B is formed at a place where the plastic material is connected with the metallic material.

Figure 14:
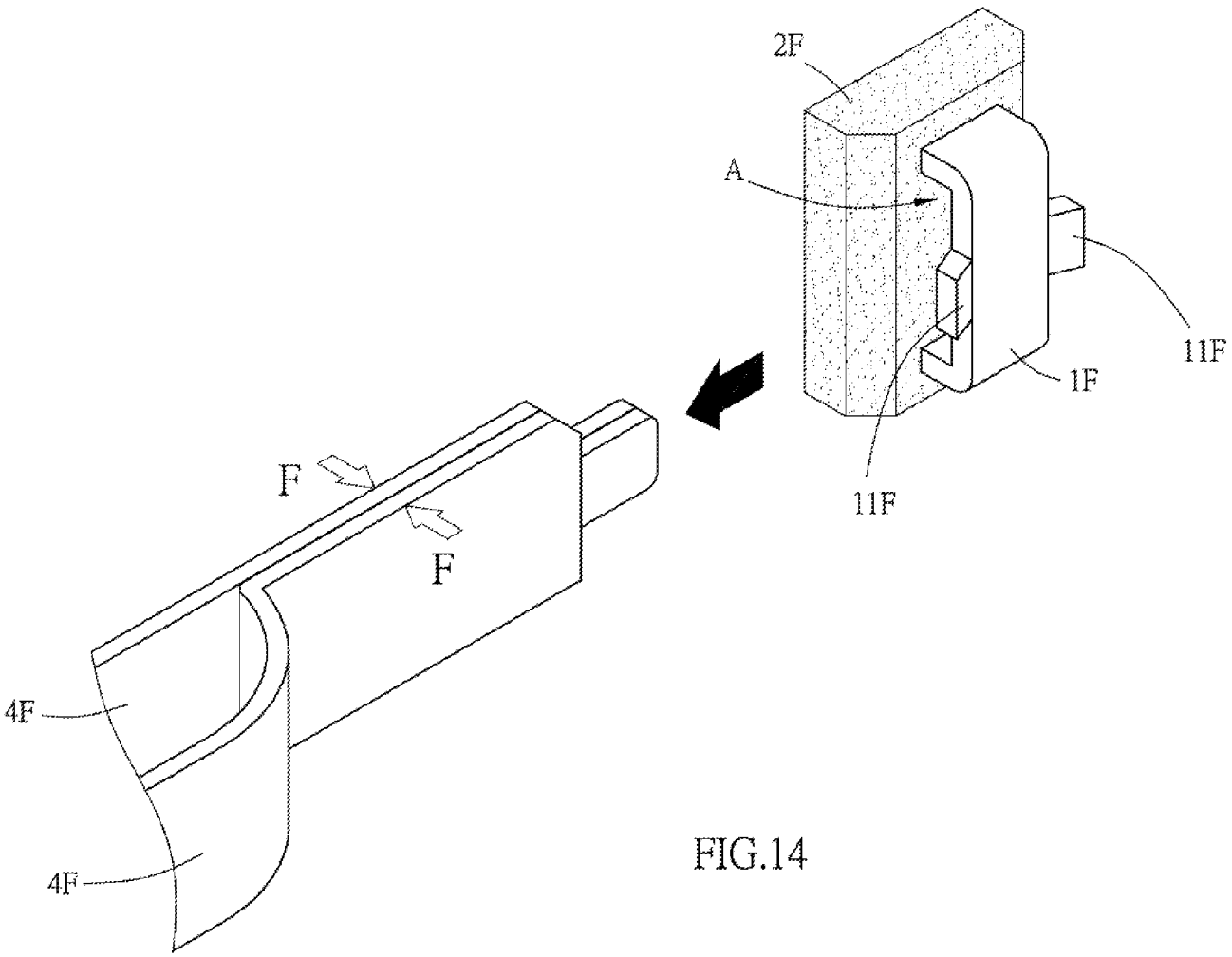
FIG. 14 shows an exploded view of combining the overheating destructive conductive plate safety clip with the conductive plates, according to the second embodiment of the present invention.
Figure 15:
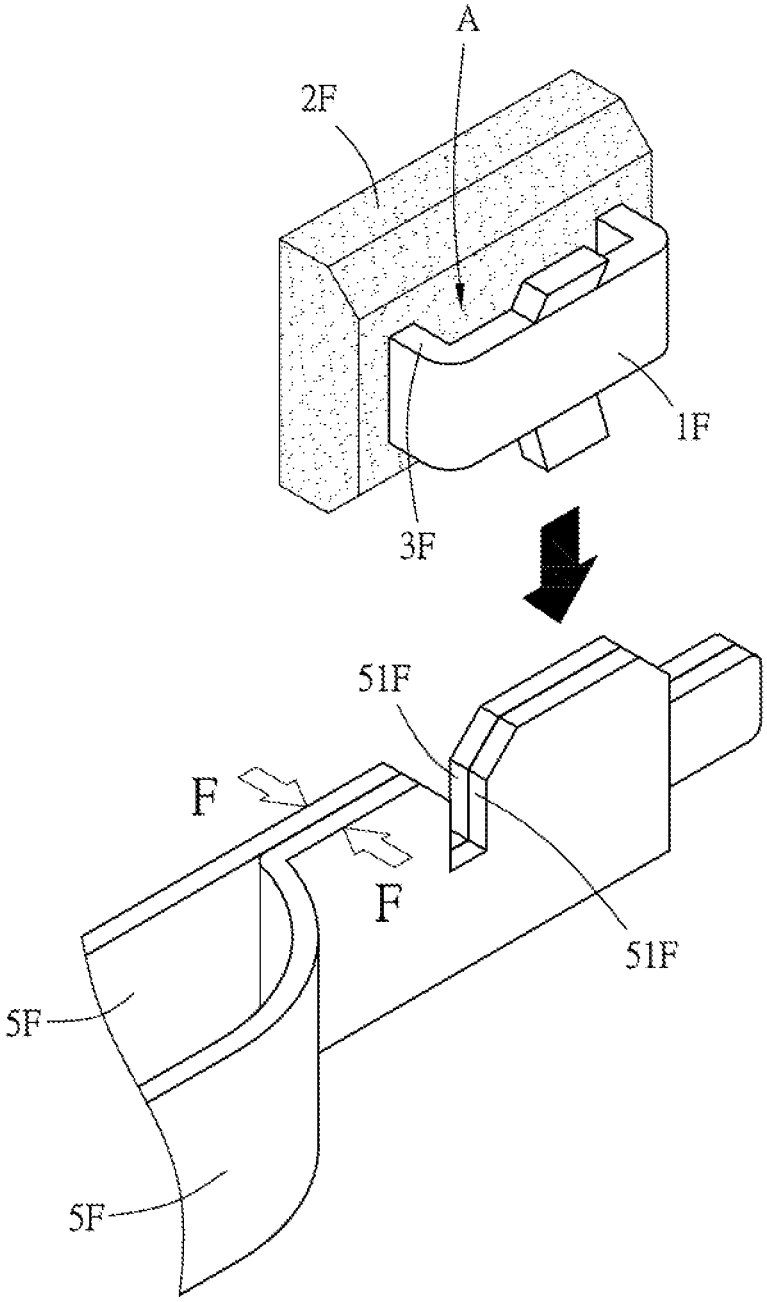
FIG. 15 shows a schematic view of combining the overheating destructive conductive plate safety clip with the conductive plates, according to the second embodiment of the present invention.

Referring to FIG. 14, there are two conductive plates 4F, and the overheating destructive conductive plate safety clip is sheathed on from end parts of the two conductive plates 4F, such that the two conductive plates 4F can be contained in the holding space A, enabling the two conductive plates 4F to be limited from contacting with each other to form a closed path. The fins 11F facilitate a user to exert a force to sheath the overheating destructive conductive plate safety clip onto the two conductive plates 4F. Furthermore, referring to FIG. 15, there are two conductive plates 5F and each conductive plate 5F is provided with a groove 51F which is concaved in from an edge of the said conductive plate 5F. The grooves 51F on the two conductive plates 5F are opposite to each other and the connecting element 3F is put into the grooves 51F, such that the two conductive plates 5F can be contained in the holding space A, enabling the two conductive plates 5F to be limited from contacting with each other to form a closed path. In other words, for the overheating destructive conductive plate safety clip, according to the present embodiment, whether there are grooves formed on the two conductive plates, the overheating destructive conductive plate safety clip can all be sheathed onto the two conductive plates.

Figure 16:
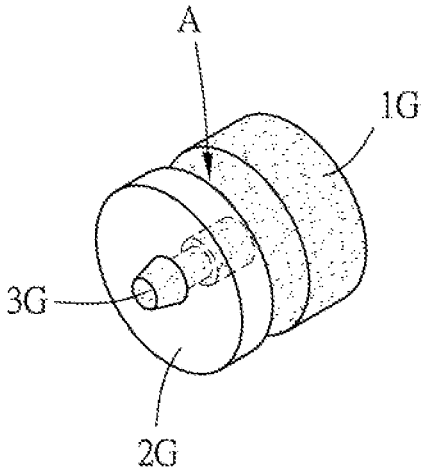
FIG. 16 shows a three-dimensional view of appearance of an overheating destructive conductive plate safety clip, according to a third embodiment of the present invention.
Figure 17:
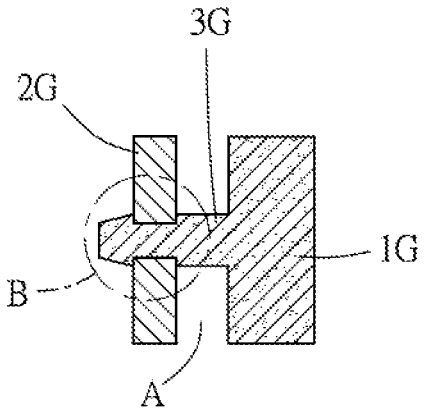
FIG. 17 shows a cutaway view of the overheating destructive conductive plate safety clip, according to the third embodiment of the present invention.

Referring to FIG. 16 and FIG. 17 for the third embodiment of the present invention, the overheating destructive conductive plate safety clip, according to the present embodiment, comprises a first limiting element 1G, a second limiting element 2G and a connecting element 3G. The connecting element 3G is connected with the first limiting element 1G and the second limiting element 2G, forming an H-shaped structure to the overheating destructive conductive plate safety clip. A holding space A is defined among the first limiting element 1G, the connecting element 3G and the second limiting element 2G. The first limiting element 1G and the connecting element 3G are made of plastic, the second limiting element 2G is made of metal, and a destruction part B is formed at a place where the plastic material is connected with the metallic material. Similarly, through the metallic second limiting element 2G, the destruction part B can be assured to be destructed actually.

Figure 18:
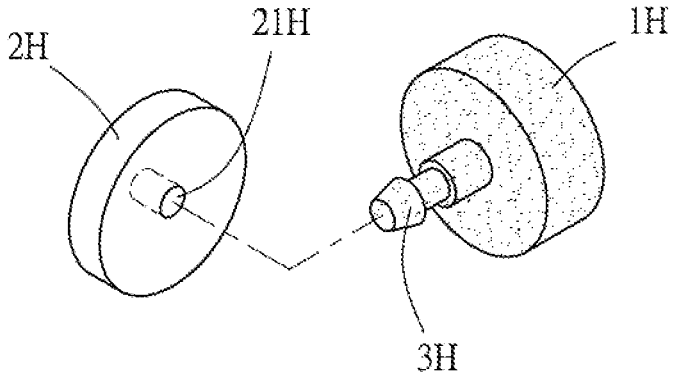
FIG. 18 shows a schematic view of a first kind of structure configuration of the overheating destructive conductive plate safety clip, according to the third embodiment of the present invention.
Figure 19:
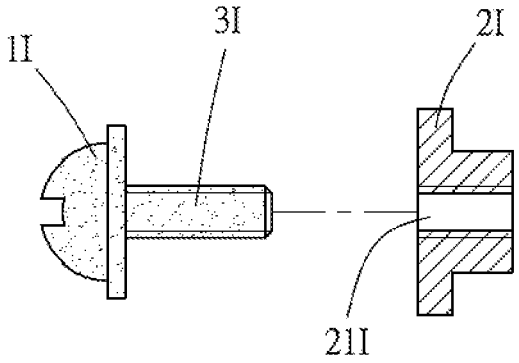
FIG. 19 shows a schematic view of a second kind of structure configuration of the overheating destructive conductive plate safety clip, according to the third embodiment of the present invention.
Figure 20:
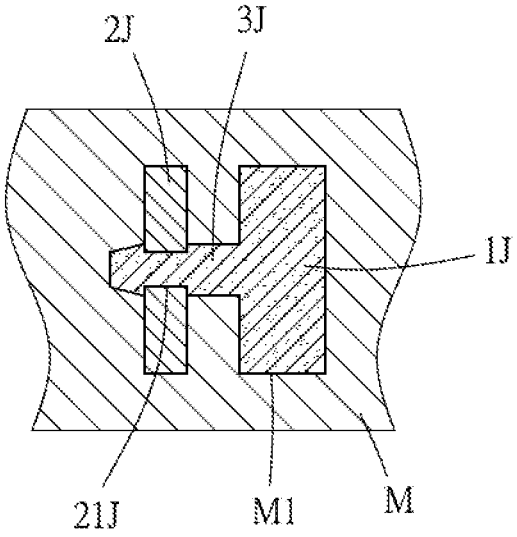
FIG. 20 shows a schematic view of a third kind of structure configuration of the overheating destructive conductive plate safety clip, according to the third embodiment of the present invention.
Figure 21:
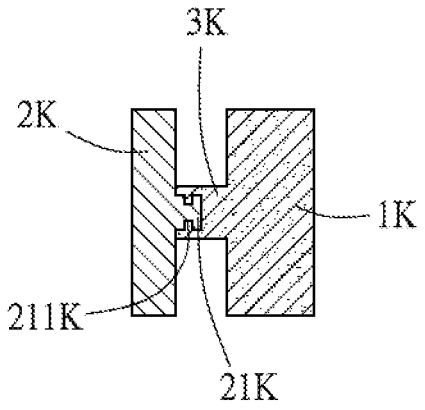
FIG. 21 shows a schematic view of a fourth kind of structure configuration of the overheating destructive conductive plate safety clip, according to the third embodiment of the present invention.
Figure 22:
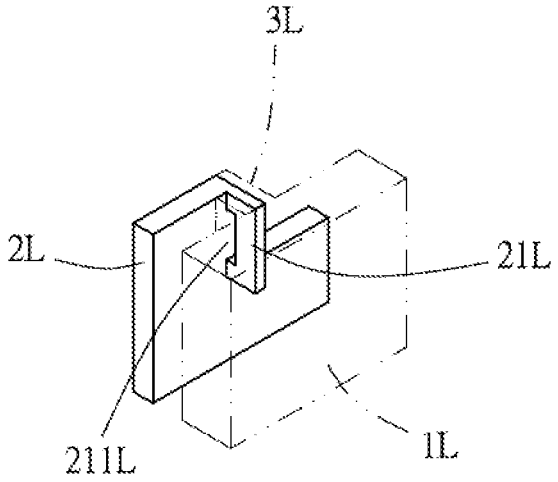
FIG. 22 shows a schematic view of a fifth kind of structure configuration of the overheating destructive conductive plate safety clip, according to the third embodiment of the present invention.

The overheating destructive conductive plate safety clip is provided with following structures:

1. As shown in FIG. 18, the overheating destructive conductive plate safety clip includes a first limiting element 1H, a second limiting element 2H and a connecting element 3H. The first limiting element 1H is formed integrally with the connecting element 3H, a through-hole 21H is first formed on the second limiting element 2H, and then the connecting element 3H is latched into the through-hole 21H through secondary processing.
2. As shown in FIG. 19, the overheating destructive conductive plate safety clip includes a first limiting element 1I, a second limiting element 2I and a connecting element 3I. The first limiting element 1I is a head part of a bolt, the connecting element 3I is a threaded part of the bolt, and the second limiting element 2I is formed with a threaded hole 21I to be screwed in by the threaded part.
3. As shown in FIG. 20, the overheating destructive conductive plate safety clip includes a first limiting element 1J, a second limiting element 2J and a connecting element 3J. The second limiting element 2J is provided with a through-hole 21J, the second limiting element 2J is put into a mold cavity M1 of a mold M, and the first limiting element 1J and the connecting element 3J are formed by bagging formation on the second limiting element 2J, such that the connecting element 3J can be connected with the second limiting element 2J and latched into the through-hole 21J.
4. As shown in FIG. 21, the overheating destructive conductive plate safety clip includes a first limiting element 1K, a second limiting element 2K and a connecting element 3K. The second limiting element 2K is formed with a bump 21K, and the bump 21K is provided with a notch 211K. The first limiting element 1K and the connecting element 3K are formed by bagging formation on the second limiting element 2K, such that the connecting element 3K can be connected with the second limiting element 2K and latched into the notch 211K of the bump 21K.
5. As shown in FIG. 22, the overheating destructive conductive plate safety clip includes a first limiting element 1L, a second limiting element 2L and a connecting element 3L. The second limiting element 2L is first stamped into a protruded part 21L which is provided with a coupling hole 211L. The first limiting element 1L and the connecting element 3L are formed by bagging formation on the second limiting element 2L, such that the connecting element 3L can be connected with the protruded part 21L of the second limiting element 2L and latched into the coupling hole 211L.

Figure 23:
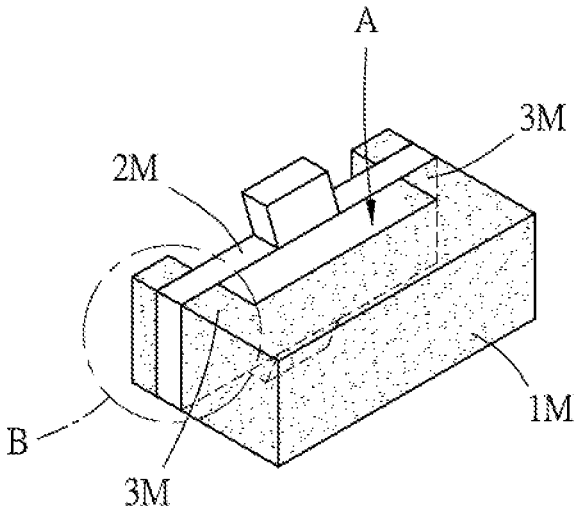
FIG. 23 shows a three-dimensional view of appearance of an overheating destructive conductive plate safety clip, according to a fourth embodiment of the present invention.

Referring to FIG. 23 for the fourth embodiment of the present invention, the overheating destructive conductive plate safety clip, according to the present embodiment, comprises a first limiting element 1M, a second limiting element 2M and a connecting element 3M. The first limiting element 1M and the connecting element 3M are made of plastic, the second limiting element 2M is made of metal, and the first limiting element 1M, the connecting element 3M and the second limiting element 2M wrap into an annular closed holding space A. A destruction part B is formed at a place where the plastic material is connected with the metallic material.

Figure 24:
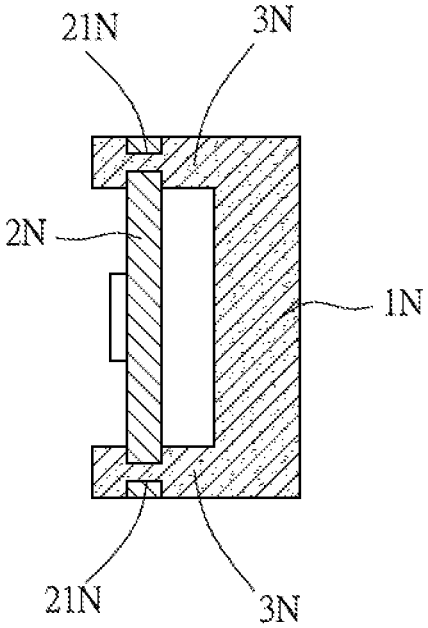
FIG. 24 shows a schematic view of a first kind of structure configuration of the overheating destructive conductive plate safety clip, according to the fourth embodiment of the present invention.
Figure 25:
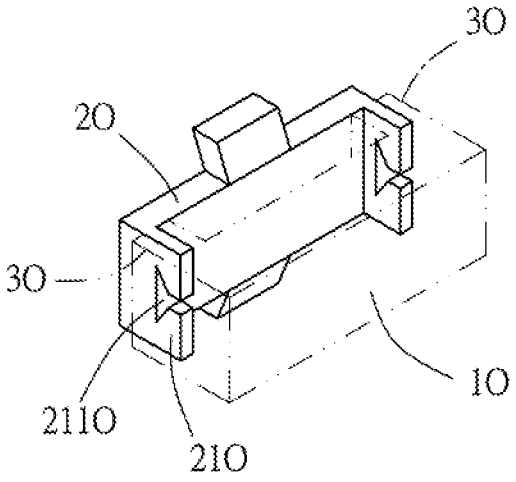
FIG. 25 shows a schematic view of a second kind of structure configuration of the overheating destructive conductive plate safety clip, according to the fourth embodiment of the present invention.

The overheating destructive conductive plate safety clip is provided with following structures:

1. As shown in FIG. 24, the overheating destructive conductive plate safety clip includes a first limiting element 1N, a second limiting element 2N and a connecting element 3N. The second limiting element 2N is first formed with a recessed hole 21N, and the connecting element 3N is connected with the second limiting element 2N and then latched into the recessed hole 21N.
2. As shown in FIG. 25, the overheating destructive conductive plate safety clip includes a first limiting element 1O, a second limiting element 2O and a connecting element 3O. The second limiting element 2O is first formed with a projected part 21O which is provided with a slot hole 211O. The connecting element 3O is connected with the projected part 21O and then latched into the slot hole 211O.

Figure 26:
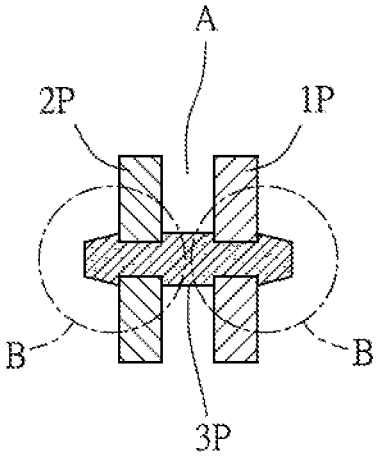
FIG. 26 shows a schematic view of an overheating destructive conductive plate safety clip, according to a fifth embodiment of the present invention.

Referring to FIG. 26 for the fifth embodiment of the present invention, the overheating destructive conductive plate safety clip, according to the present embodiment, comprises a first limiting element 1P, a second limiting element 2P and a connecting element 3P. The connecting element 3P is connected with the first limiting element 1P and the second limiting element 2P, forming an H-shaped structure to the overheating destructive conductive plate safety clip. A holding space A is defined among the first limiting element 1P, the connecting element 3P and the second limiting element 2P. The connecting element 3P is made of plastic, the first limiting element 1P and the second limiting element 2P are made of metal, and a destruction part B is formed at a place where the plastic material is connected with the metallic material. Similarly, through the metallic first limiting element 1P and second limiting element 2P, the destruction part B can be assured to be destructed actually.

Figure 27:
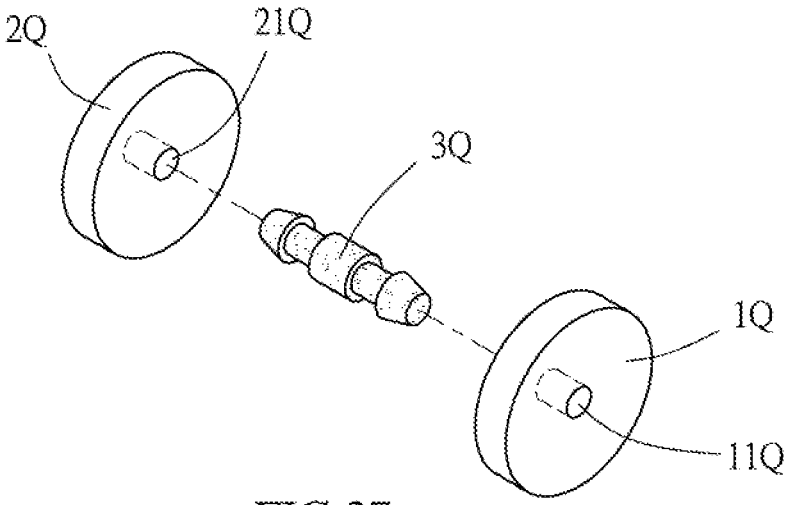
FIG. 27 shows a schematic view of a first kind of structure configuration of the overheating destructive conductive plate safety clip, according to the fifth embodiment of the present invention.
Figure 28:
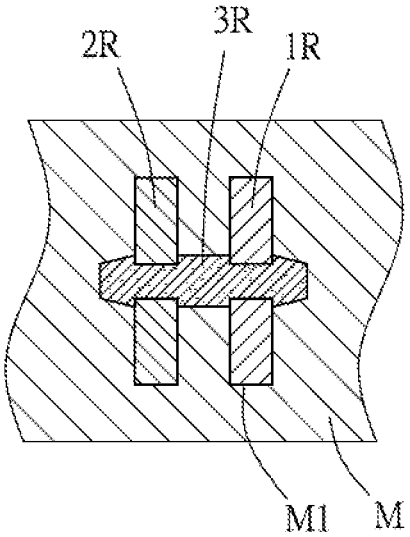
FIG. 28 shows a schematic view of a second kind of structure configuration of the overheating destructive conductive plate safety clip, according to the fifth embodiment of the present invention.

The overheating destructive conductive plate safety clip is provided with following structures:

1. As shown in FIG. 27, the overheating destructive conductive plate safety clip includes a first limiting element 1Q, a second limiting element 2Q and a connecting element 3Q. The first limiting element 1Q and the second limiting element 2Q are first formed with a through-hole 11Q, 21Q, and then the connecting element 3Q is latched into the through-holes 11Q, 21Q through secondary processing.
2. As shown in FIG. 28, the overheating destructive conductive plate safety clip includes a first limiting element 1R, a second limiting element 2R and a connecting element 3R. The first limiting element 1R and the second limiting element 2R are put into a mold cavity M1 of a mold M, the connecting element 3R is formed by bagging formation on the first limiting element 1R and the second limiting element 2R, and the connecting element 3R is connected with the first limiting element 1R and the second limiting element 2R.

Figure 29:
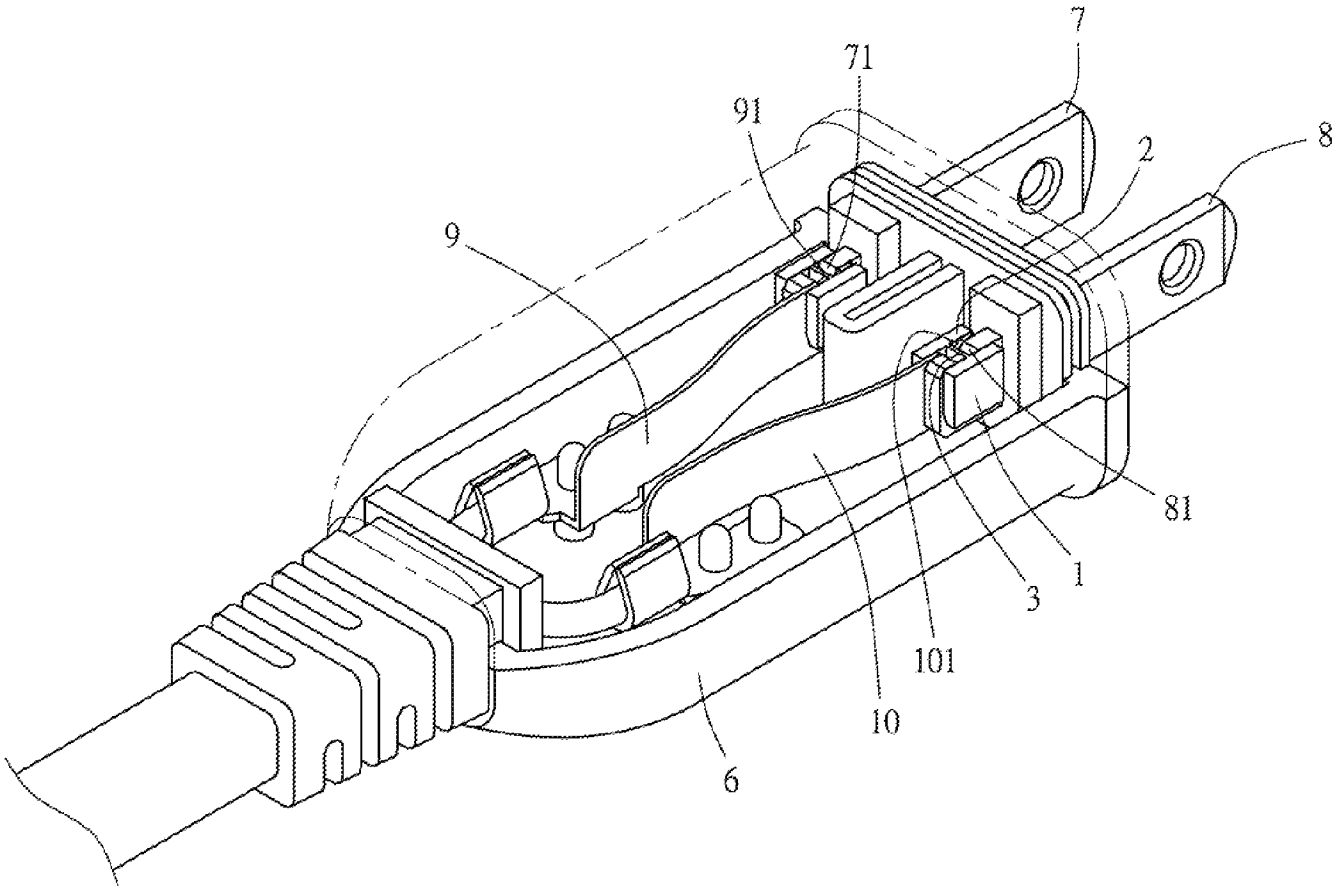
FIG. 29 shows a schematic view of using an overheating destructive conductive plate safety clip on a plug, according to the present invention.

Referring to FIG. 29, the overheating destructive conductive plate safety clip, according to the first embodiment of the present invention, is used in overheat protection for a plug. The plug of the present embodiment comprises an insulative unit 6, a live wire pin 7, a neutral line pin 8, a live wire 9 and a neutral line 10. The live wire pin 7 and the neutral line pin 8 are all disposed in the insulative unit 6 and extended out of the insulative unit 6. The live wire pin 7 and the neutral line pin 8 are provided respectively with a first groove 71, 81. The first groove 71 is concaved in from an edge of the live wire pin 7, and the first groove 81 is concaved in from an edge of the neutral line pin 8. The live wire 9 and the neutral line 10 correspond to the live wire pin 7 and the neutral line pin 8, respectively. In addition, the live wire 9 and the neutral line are provided respectively with a second groove 91, 101 corresponding to the first groove 71, 81. The second groove 91 is concaved in from an edge of the live wire 9, and the second groove 101 is concaved in from an edge of the neutral line 10.

By putting the connecting element 3 of the overheating destructive conductive plate safety clip into the first groove 71 of the live wire pin 7 and the second groove 91 of the live wire 9, and using the first limiting element 1 and the second limiting element 2 of the overheating destructive conductive plate safety clip to restrain the live wire pin 7 and live wire 9, the live wire pin 7 and the live wire 9 can contact with each other to form a closed path; and by putting the connecting element 3 of the overheating destructive conductive plate safety clip into the first groove 81 of the neutral line pin 8 and the second groove 101 of the neutral line 10, and using the first limiting element 1 and the second limiting element 2 of the overheating destructive conductive plate safety clip to restrain the neutral line pin 8 and neutral line 10, the neutral line pin 8 and the neutral line 10 can contact with each other to form a closed path. When the live wire pin 7 and the live wire 9 are overheated, and when the neutral line pin 8 and the neutral line 10 are overheated, the metallic material in the first limiting element 1 and the second limiting element 2 will absorb heat, so that the destruction part B can be destructed completely (referring to FIG. 2 for the destruction part), which enables the live wire pin 7 and the live wire 9 to be opened with respect to each other and the neutral line pin 8 and the neutral line 10 to be opened with respect to each other by an elastic force, thereby forming an open circuit.

Figure 30:
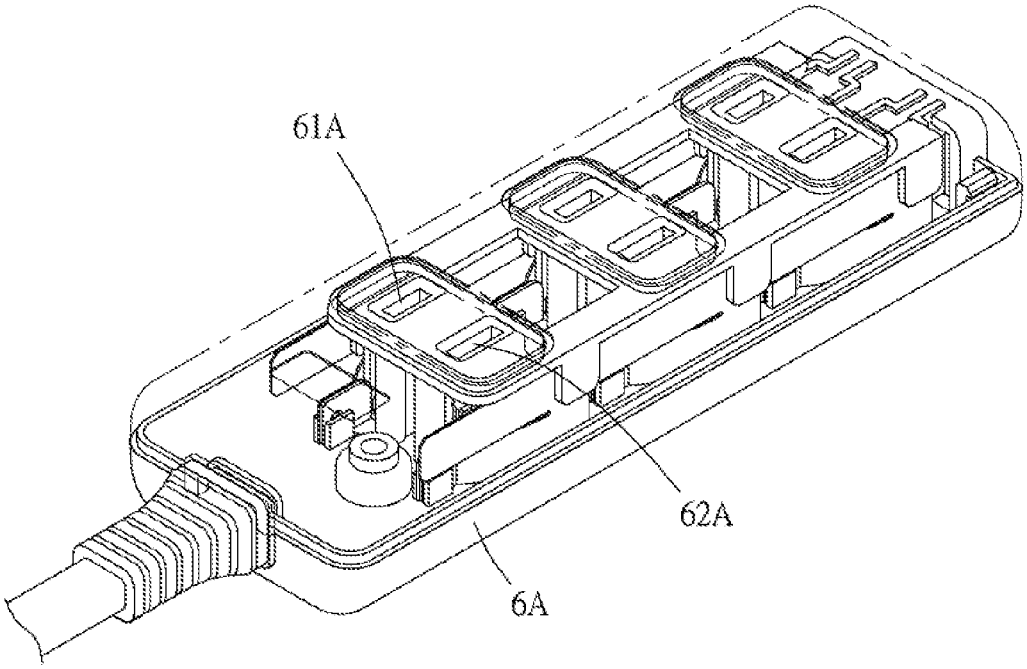
FIG. 30 shows a schematic view of using an overheating destructive conductive plate safety clip on a socket, according to the present invention.
Figure 31:
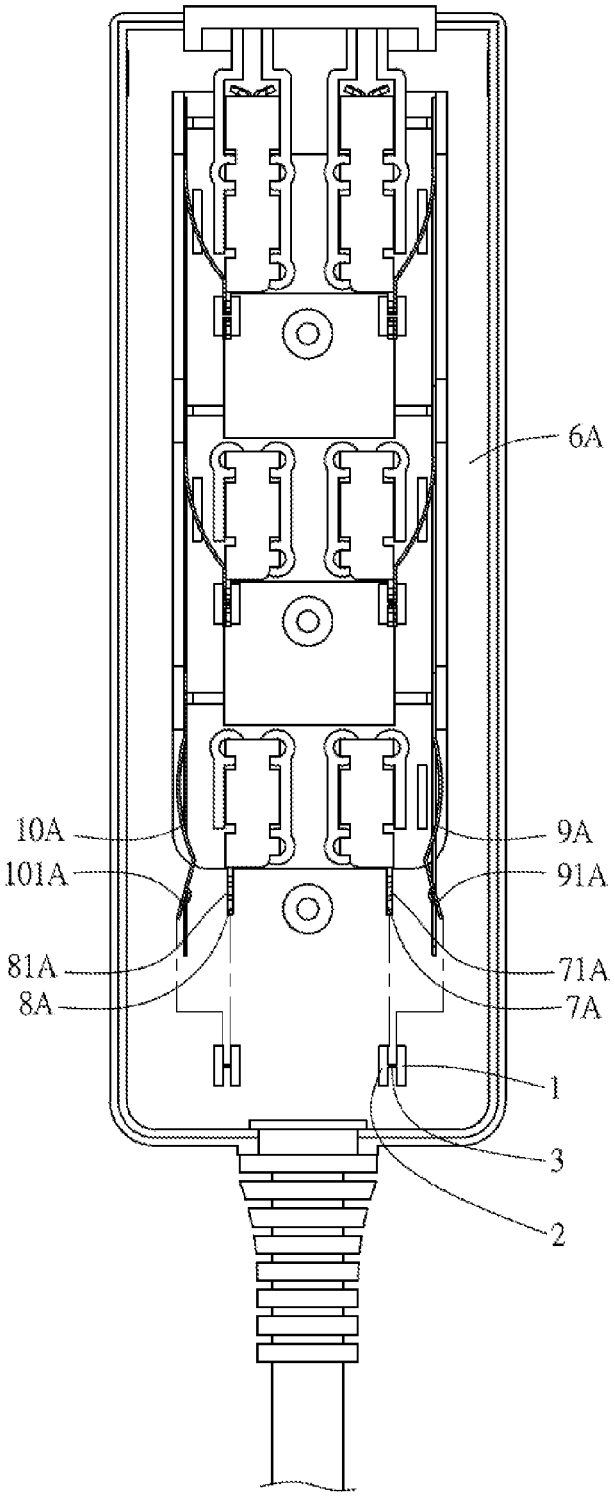
FIG. 31 shows another schematic view of using the overheating destructive conductive plate safety clip on a socket, according to the present invention.

Referring to FIG. 30 and FIG. 31, the overheating destructive conductive plate safety clip, according to the first embodiment of the present invention, is used in overheat protection for a socket. The socket of the present embodiment comprises an insulative unit 6A which is provided with a live wire receptacle 61A and a corresponding neutral line receptacle 62A; a live wire terminal 7A which is installed in the insulative unit 6A and corresponds to the live wire receptacle 61A, and a neutral line terminal 8A which is installed in the insulative unit 6A and corresponds to the neutral line receptacle 62A, with that the live wire terminal 7A and the neutral line terminal 8A are provided respectively with a first groove 71A, 81A concaved in from an edge of the live wire terminal 7A and from an edge of the neutral line terminal 8A; a live wire 9A which corresponds to the live wire terminal 7A, and a neutral line 10A which corresponds to the neutral line terminal 8A, with that the live wire 9A and the neutral line 10A are provided respectively with a second groove 91A, 101A corresponding to the first groove 71A, 81A, and with that the second grooves 91A, 101A are concaved in from an edge of the live wire 9A and from an edge of the neutral line 10A.

By putting the connecting element 3 of the overheating destructive conductive plate safety clip into the first groove 71A of the live wire terminal 7A and the second groove 91A of the live wire 9A, and using the first limiting element 1 and the second limiting element 2 of the overheating destructive conductive plate safety clip to restrain the live wire terminal 7A and the live wire 9A, the live wire terminal 7A and the live wire 9A can contact with each other to form a closed path; and by putting the connecting element 3 of the overheating destructive conductive plate safety clip into the first groove 81A of the neutral line terminal 8A and the second groove 101A of the neutral line 10A, and using the first limiting element 1 and the second limiting element 2 of the overheating destructive conductive plate safety clip to restrain the neutral line terminal 8A and the neutral line 10A, the neutral line terminal 8A and the neutral line 10A can contact with each other to form a closed path. In addition, when the live wire terminal 7A and the live wire 9A are overheated, and when the neutral line terminal 8A and the neutral line 10A are overheated, the metallic material in the first limiting element 1 and the second limiting element 2 will absorb heat, so that the destruction part B can be destructed completely (referring to FIG. 2 for the destruction part B), which enables the live wire terminal 7A and the live wire 9A to be opened with respect to each other and the neutral line terminal 8A and the neutral line 10A to be opened with respect to each other by an elastic force, thereby forming an open circuit.

It is of course to be understood that the embodiments described herein is merely illustrative of the principles of the invention and that a wide variety of modifications thereto may be effected by persons skilled in the art without departing from the spirit and scope of the invention as set forth in the following claims.

What is claimed is:

1. An overheating destructive conductive plate safety clip, being used to limit two conductive plates from contacting with each other to form a closed path, and the conductive plate safety clip being destructed when overheating, enabling the two conductive plates to be opened with respect to each other by an elastic force to form an open circuit, wherein the overheating destructive conductive plate safety clip comprising a first limiting element, a second limiting element and a connecting element, wherein the connecting element is connected with the first limiting element and the second limiting element, a holding space is defined among the first limiting element, the connecting element and the second limiting element to contain the two conductive plates, enabling the first limiting element and the second limiting element to be abutted respectively at an external side of the conductive plate and the two conductive plates to be limited from contacting with each other; at least one of the first limiting element, the second limiting element and the connecting element being made of plastic material, at least one of the first limiting element and the second limiting element being made of metal material, and a destruction part being formed at a place where the plastic material is connected with the metallic material; when the two conductive plates are overheated, the metallic material in the first limiting element and the second limiting element absorbing heat, enabling the destruction part to be destructed completely.

2. The overheating destructive conductive plate safety clip, according to claim 1, wherein the first limiting element and the connecting element are made of metal material and the second limiting element is made of plastic material.

3. The overheating destructive conductive plate safety clip, according to claim 2, wherein each of the two conductive plates is provided with a groove which is concaved in from an edge of the conductive plate, the grooves on the two conductive plates are opposite to each other, cross section of the first limiting element, the connecting element and the second limiting element is in an H-shape, which enables the connecting element to be put into the grooves, so that the two conductive plates are contained in the holding space.

4. The overheating destructive conductive plate safety clip, according to claim 3, wherein the second limiting element is first formed with a groove and the connecting element is then latched into the groove through secondary processing.

5. The overheating destructive conductive plate safety clip, according to claim 3, wherein the first limiting element is a head part of a bolt, the connecting element is a threaded part of the bolt, and the second limiting element is formed with a threaded hole to be screwed in by the threaded part.

6. The overheating destructive conductive plate safety clip, according to claim 3, wherein the second limiting element is connected with the connecting element through bagging formation.

7. The overheating destructive conductive plate safety clip, according to claim 3, wherein the connecting element is formed by stamping the first limiting element.

8. The overheating destructive conductive plate safety clip, according to claim 3, wherein the first limiting element and the connecting element are formed by bending a wire.

9. The overheating destructive conductive plate safety clip, according to claim 2, wherein the first limiting element, the connecting element and the second limiting element wrap into an annular closed holding space, enabling the two conductive plates to be sheathed and contained in the holding space.

10. The overheating destructive conductive plate safety clip, according to claim 9, wherein two opposite sides of the first limiting element are formed respectively with a fin.

11. The overheating destructive conductive plate safety clip, according to claim 1, wherein the first limiting element and the connecting element are made of plastic material, and the second limiting element is made of metal material.

12. The overheating destructive conductive plate safety clip, according to claim 11, wherein each of the two conductive plates is provided with a groove which is concaved in from an edge of the conductive to plate, the grooves on the two conductive plates are opposite to each other, cross section of the first limiting element, the connecting element and the second limiting element is in an H-shape, which enables the connecting element to be put into the grooves, so that the two conductive plates are contained in the holding space.

13. The overheating destructive conductive plate safety clip, according to claim 12, wherein the second limiting element is first formed with a through-hole, and the connecting element is then latched into the through-hole through secondary processing.

14. The overheating destructive conductive plate safety clip, according to claim 12, wherein the first limiting element is a head part of a bolt, the connecting element is a threaded part of the bolt, and the second limiting element is formed with a threaded hole to be screwed in by the threaded part.

15. The overheating destructive conductive plate safety clip, according to claim 12, wherein the second limiting element is provided with a through-hole, whereas the first limiting element and the connecting element are connected with the second limiting element and latched into the through-hole through bagging formation.

16. The overheating destructive conductive plate safety clip, according to claim 12, wherein the second limiting element is formed with a bump, the bump is provided with a notch, and the connecting element is connected with the second limiting element and then latched into the notch of the bump.

17. The overheating destructive conductive plate safety clip, according to claim 12, wherein the second limiting element is first stamped into a protruded part which is provided with a coupling hole, and then the connecting element is connected with the protruded part of the second limiting element and latched into the coupling hole.

18. The overheating destructive conductive plate safety clip, according to claim 11, wherein the first limiting element, the connecting element and the second limiting element wrap into an annular closed holding space, enabling the two conductive plates to be sheathed and contained in the holding space.

19. The overheating destructive conductive plate safety clip, according to claim 18, wherein the second limiting element is formed with a recessed hole, and the connecting element is connected with the second limiting element and then latched into the recessed hole.

20. The overheating destructive conductive plate safety clip, according to claim 18, wherein the second limiting element is formed with a projected part which is provided with a slot hole, and the connecting element is connected with the projected part and then latched into the slot hole.

21. The overheating destructive conductive plate safety clip, according to claim 1, wherein the connecting element is made of plastic material, and the first limiting element and the second limiting element are made of metal material.

22. The overheating destructive conductive plate safety clip, according to claim 21, wherein each of the two conductive plates is provided with a groove which is concaved in from an edge of the conductive plate, the grooves on the two conductive plates are opposite to each other, and cross section of the first limiting element, the connecting element and the second limiting element is in an H-shape, which enables the connecting element to be put into the grooves, so that the two conductive plates are contained in the holding space.

23. The overheating destructive conductive plate safety clip, according to claim 22, wherein the first limiting element and the second limiting element are first formed with a through-hole, and the connecting element is then latched into the through-hole through secondary processing.

24. The overheating destructive conductive plate safety clip, according to claim 22, wherein the connecting element is connected with the first limiting element and the second limiting element through bagging formation.

25. A plug using the overheating destructive conductive plate safety clip, according to claim 1, comprising:

an insulative unit;

a live wire pin and a neutral line pin which are all disposed in the insulative unit and extended out of the insulative unit, with that the live wire pin and the neutral line pin are provided respectively with a first groove concaved in from an edge of the live wire pin and from an edge of the neutral line pin; and a live wire and a neutral line which are provided respectively with a second groove concaved in from an edge of the live wire and from an edge of the neutral line;

by putting the connecting element of the overheating destructive conductive plate safety clip into the first groove of the live wire pin and the second groove of the live wire, and using the first limiting element and the second limiting element of the overheating destructive conductive plate safety clip to restrain the live wire pin and the live wire, the live wire pin and the live wire contacting with each other to form a closed path; and by putting the connecting element of the overheating destructive conductive plate safety clip into the first groove of the neutral line pin and the second groove of the neutral line, and using the first limiting element and the second limiting element of the overheating destructive conductive plate safety clip to restrain the neutral line pin and the neutral line, the neutral line pin and the neutral line contacting with each other to form a closed path; when the live wire pin and the live wire are overheated, and when the neutral line pin and the neutral line are overheated, the metallic material in the first limiting element and the second limiting element absorbing heat, so that the destruction part is destructed completely, which enables the live wire pin and the live wire to be opened with respect to each other, and the neutral line pin and the neutral line to be opened with respect to each other, by an elastic force, thereby forming an open circuit.

26. A socket using the overheating destructive conductive plate safety clip, according to claim 1, comprising:

an insulative unit which is provided with a live wire receptacle and a neutral line receptacle;

a live wire terminal which is installed in the insulative unit and corresponds to the live wire receptacle, and a neutral line terminal which is installed in the insulative unit and corresponds to the neutral line receptacle, with that the live wire terminal and the neutral line terminal are provided respectively with a first groove concaved in from an edge of the live wire terminal and from an edge of the neutral line terminal; and a live wire which corresponds to the live wire terminal, and a neutral line which corresponds to the neutral line terminal, with that the live wire and the neutral line are provided respectively with a second groove concaved in from an edge of the live wire and from an edge of the neutral line;

by putting the connecting element of the overheating destructive conductive plate safety clip into the first groove of the live wire terminal and the second groove of the live wire, and using the first limiting element and the second limiting element of the overheating destructive conductive plate safety clip to restrain the live wire terminal and the live wire, the live wire terminal and the live wire contacting with each other to form a closed path; and by putting the connecting element of the overheating destructive conductive plate safety clip into the first groove of the neutral line terminal and the second groove of the neutral line, and using the first limiting element and the second limiting element of the overheating destructive conductive plate safety clip to restrain the neutral line terminal and the neutral line, the neutral line terminal and the neutral line contacting with each other to form a closed path; when the live wire terminal and the live wire are overheated, and when the neutral line terminal and the neutral line are overheated, the metallic material in the first limiting element and the second limiting element absorbing heat, so that the destruction part is destructed completely, which enables the live wire terminal and the live wire to be opened with respect to each other, and the neutral line terminal and the neutral line to be opened with respect to each other, by an elastic force, thereby forming an open circuit.

* * * * *